US006346681B1

(12) United States Patent
Joyce et al.

(10) Patent No.: US 6,346,681 B1
(45) Date of Patent: Feb. 12, 2002

(54) PRESSURE SWITCH

(76) Inventors: Ronald S. Joyce, 562 Jersey La., Elk Grove Village, IL (US) 60007; Carl H. Poppe, 351 S. Julian, Naperville, IL (US) 60540; Paul H. Tuma, 582 S. Craig Pl., Lombard, IL (US) 60148

( * ) Notice: Subject to any disclaimer, the term of this patent is extended or adjusted under 35 U.S.C. 154(b) by 857 days.

(21) Appl. No.: 08/534,965

(22) Filed: Sep. 28, 1995

(51) Int. Cl.[7] ..... H01H 35/34
(52) U.S. Cl. ..... 200/835; 200/83 R; 200/83 P
(58) Field of Search ..... 200/82 R, 82 A, 200/83 R, 83 WM, 83 J, 83 P, 835, 835 A

(56) References Cited

U.S. PATENT DOCUMENTS 3,436,502 A * 4/1969 Egli ..... 200/83
3,764,763 A * 10/1973 Barnes ..... 200/835 A
3,984,650 A * 10/1976 Budlane et al. ..... 200/83 R
4,297,552 A 10/1981 Lauritsen et al. ..... 200/83 P
4,671,116 A * 6/1987 Glennon et al. ..... 73/728
4,990,728 A 2/1991 Joyce ..... 200/83 P
5,252,792 A * 10/1993 Joyce ..... 200/83 P

* cited by examiner

*Primary Examiner*—Michael Friedhofer
(74) *Attorney, Agent, or Firm*—John M. England, Jr.; Terrence (Terry) Martin; Jules Jay Morris

(57) ABSTRACT

A pressure switch having a pressure responsive diaphragm with a backing plate for operating a snap-acting switch. The switch has a cantilevered contact blade spring with an adjustment screw providing a reaction support at the free end. The middle portion of the contact blade spring provides a preload bias against the diaphragm backing plate. The blade spring includes a moveable electrical contact on a tang formed in the middle region and includes an over-center spring for effecting a snap action of the moveable contact against stationary contacts. The actuation-deactuation differential is determined, independently of the pressure setting for switch actuation, by setting the position of the stationary contacts.

11 Claims, 5 Drawing Sheets

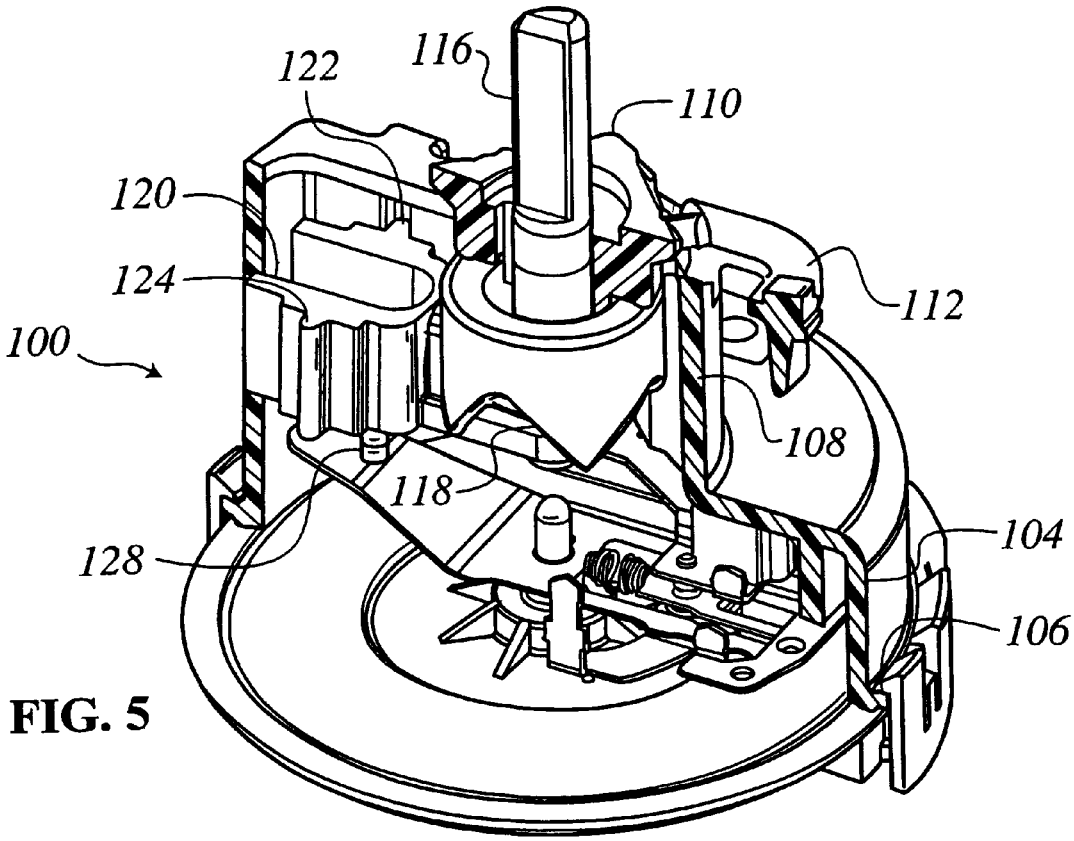
FIG. 5
FIG. 6
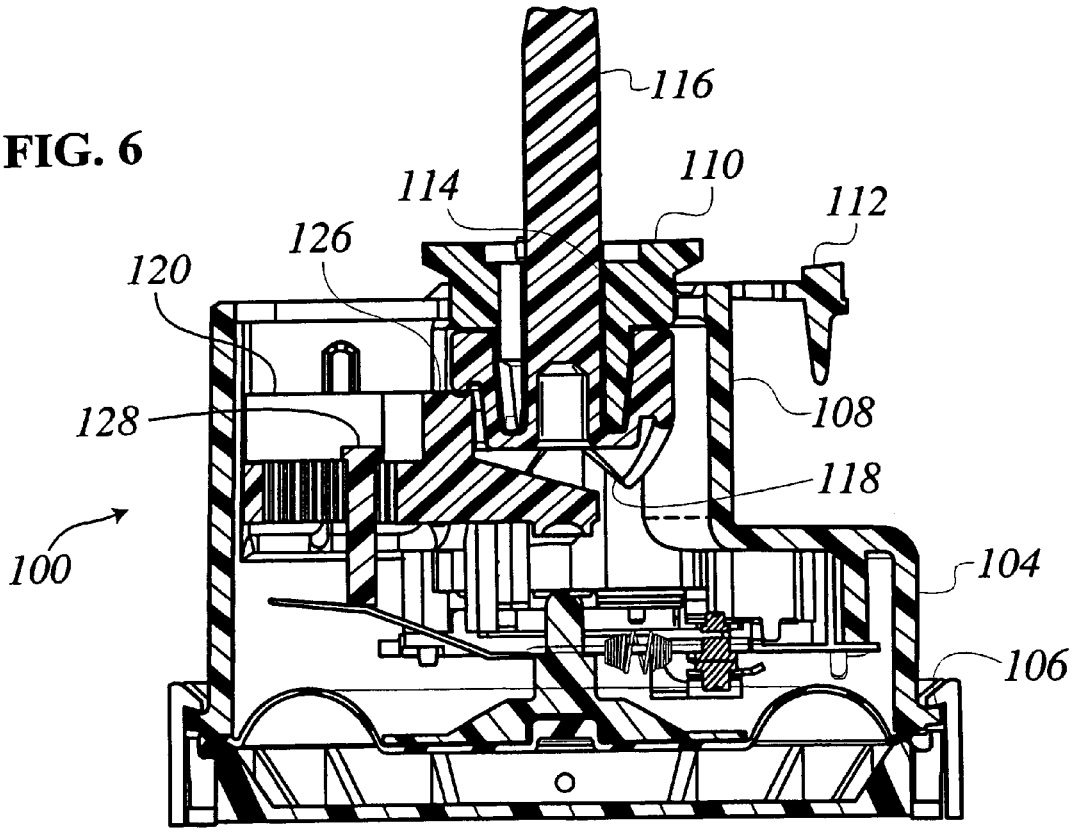

PRESSURE SWITCH

BACKGROUND OF THE INVENTION

The present invention relates to pressure switches and particularly those of the type intended for operation at a relatively low gauge pressure on the order of 1 psig with a narrow or tightly controlled differential between trip and reset or between actuation and deactuation. Such switches find common application in automatic clothes washing machines where it is desired to control certain machine electrical functions in response to the water level or pressure head sensed in the washing receptacle or drum. Typically in mass produced automatic clothes washing machines a sensing port is provided in the washing tub or drum with a tube connected from the sensing port to the pressure switch. The pressure in the switch sensing cavity is commonly applied in such known designs to an elastomeric diaphragm which has a rigid backing member or actuator attached thereto for applying the sum of the pressure forces acting on the diaphragm to an electrical switching mechanism.

A known pressure switch used for automatic clothes washing machine water level sensing is illustrated in FIG. 7 and has a pressure responsive diaphragm 1 disposed in a housing 2 forming a pressure sensing cavity 3 connected to inlet port 4. The diaphragm has a backing plate 5 for applying the summation of the pressure forces acting over the diaphragm 1 to a switch actuation rod 7 which in turn is connected for moving a switch actuation blade 6. The known pressure switch of FIG. 7 has the preload or bias applied directly to the diaphragm backing plate via rod 7. The actuator 5 is preloaded by the force of rod 7 which is acted upon by a preload spring 8 which is adjustable for varying the preload on the diaphragm for calibration purposes. The blade 6 has a separate tang formed therein with a double sided moveable contact 9 mounted thereon for switching between the moveable contact and stationary side contacts 10; and, an over-center spring 12 provides a snap action to the switch.

The problem encountered with the prior art pressure switches, such as switches of the design shown in FIG. 7, is that, upon calibration of the switch by adjustment of the preload on the diaphragm actuator, the differential between actuation and deactuation of the switch is varied as the preload was varied on the diaphragm by virtue the changed position of the actuator blade 6 and the tolerances on the location and spacing of the side contacts 10 and 11. During assembly and calibration, it has been found difficult to control the differential between actuation and deactuation, or trip-to-reset, over a range of pressure calibrations and tolerances on assembly of the switch contacts into the housing.

Thus, it has long been desired to find a way or means of providing a pressure switch for low pressure gauge settings, such as encountered in automatic clothes washers for water level sensing, and to provide accuracy in calibration and trip to reset and yet accomplish these functions with a minimum manufacturing cost.

SUMMARY OF THE INVENTION

The present invention provides an improved pressure switch for relatively low gauge pressure actuation and deactuation with reduced differential or variance between trip and reset and provides for accurate setting of the trip-to-reset during manufacturing.

It is an object of the present invention to provide a relatively low gauge pressure sensing pressure switch which may be calibrated for pressure actuation and independently set for the differential between trip and reset separately without interaction or of one effecting the other.

The present invention provides a pressure switch having a pressure responsive member moveable in response to changes in pressure in the switch sensing cavity formed in the housing and operable to move a cantilevered switch contact blade spring having the middle portion contacting and biasing the pressure responsive member. The blade spring includes an over-center snap mechanism which causes a tang formed in the blade spring to open and close a moveable contact mounted on the tang against a stationary switch contact. An adjustment means on the housing is operable to change the position of the free end of the blade spring to vary the bias on the pressure responsive means for changing the pressure level at which the switch actuates. The positioning of the stationary contact with respect to the moveable contact determines the differential or trip-to-reset pressure for the switch independently of the actuation point setting.

BRIEF DESCRIPTION OF THE DRAWINGS

FIG. 5 is an axonometric view of the assembled embodiment of FIG. 4 with portions of the housing cover broken away;

FIG. 6 is a cross-section of the assembled switch of FIG. 4; and,

DETAILED DESCRIPTION

Figure 1:
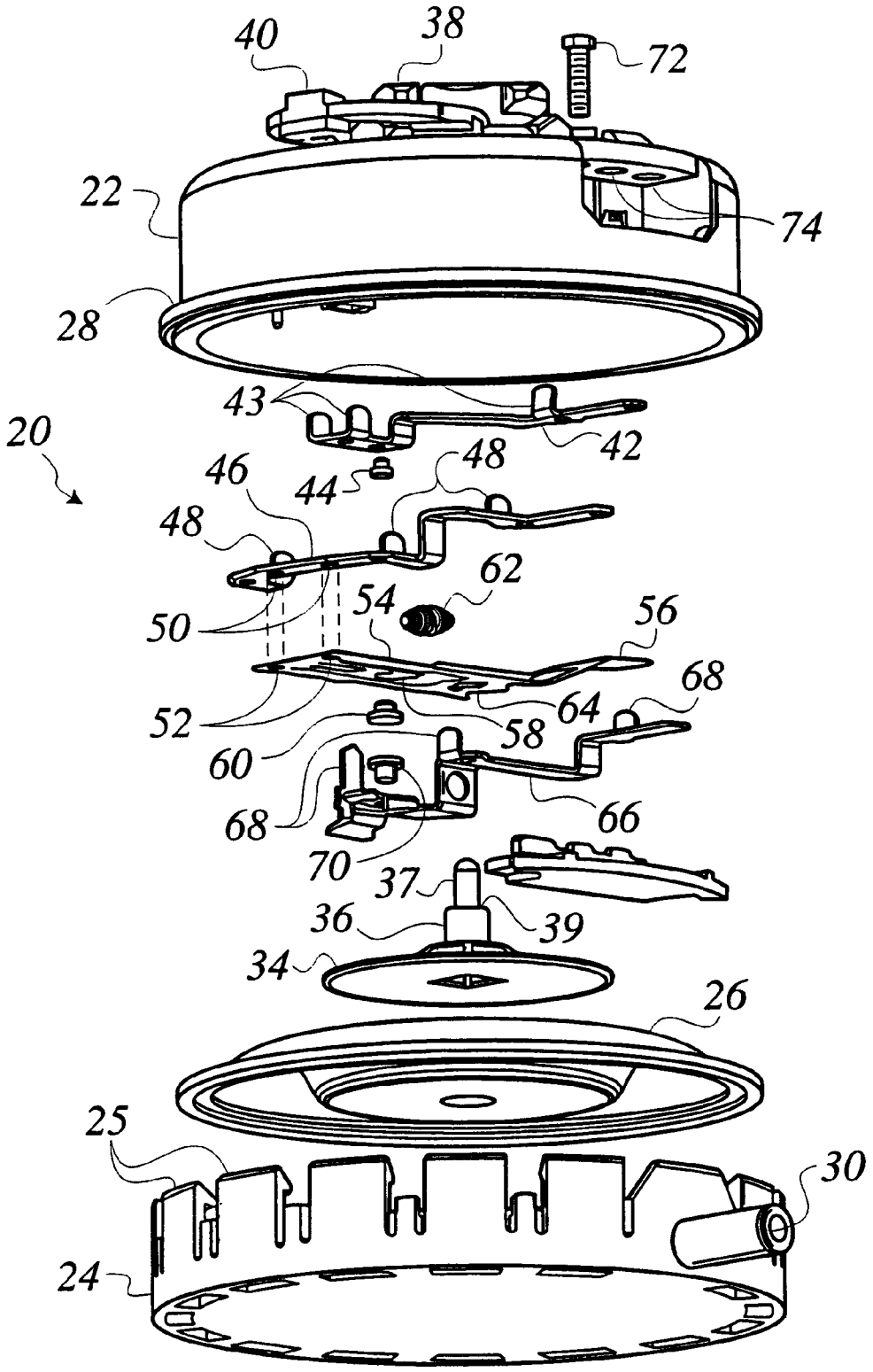
FIG. 1 is an exploded view of a single pressure level actuation embodiment of the present invention.
Figure 2:
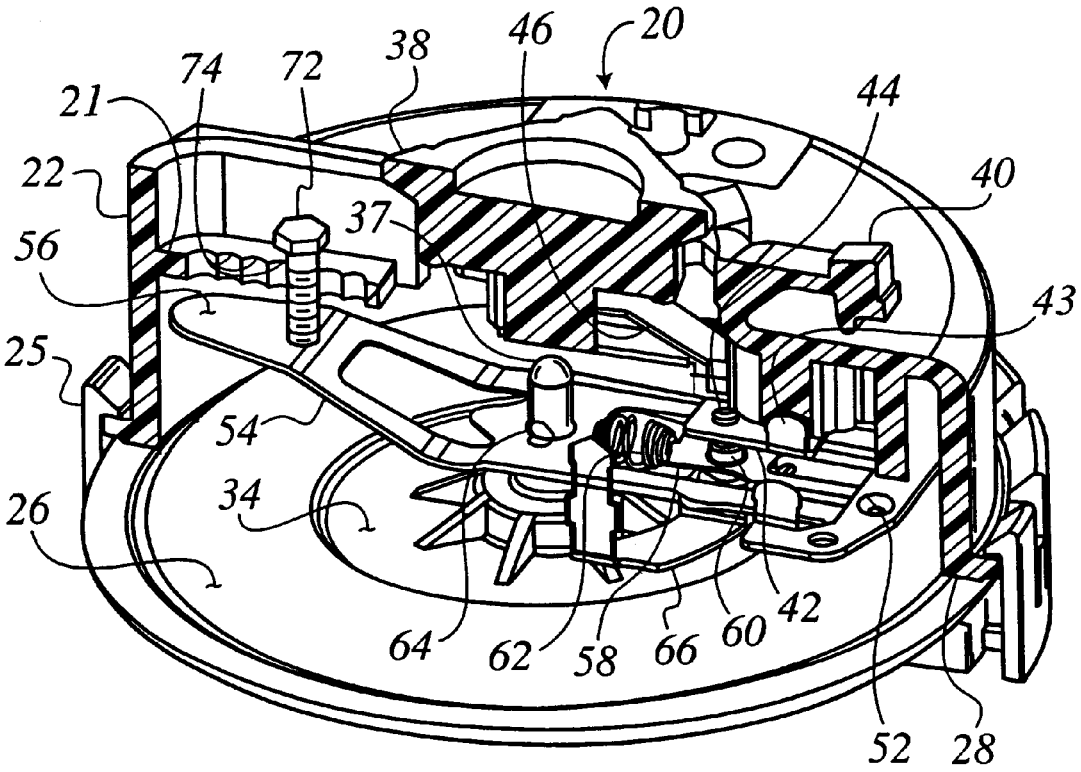
FIG. 2 is an axonometric view of the assembled embodiment of FIG. 1 with portions of the housing cover broken away.

Referring to FIGS. 1, 3, 4 and 5, the pressure switch assembly of the single setting embodiment of the present invention is indicated generally at 20 and includes housing means comprising an upper shell 22 and a base 24 with a pressure responsive elastomeric diaphragm 26 disposed therebetween. The lower open end of the shell 22 has an outwardly extending circular flange 28 which is clamped over the rim of the diaphragm 26 to seal the diaphragm in the base 24. The upper shell 22 is retained on the base 24 by a plurality of barbed tabs 25 formed about the periphery of base 24 which are snap-locked over flange 28.

A tube fitting having a pressure port 30 therein is provided on the base 24 for communicating with a pressure cavity 32 (see FIG. 3) formed in the base 24 beneath the diaphragm 26. A rigid insert or backing member 34 is provided against the upper surface of the diaphragm and member 32 includes an actuator tower 36 extending upwardly therefrom with a reduced diameter pilot portion 37.

Upper shell 22 has a polygonal twist lock mounting boss 38 with a resilient locking tab 40 for mounting and orienting the switch when mounted through a panel with the flange 38.

A first terminal connector or bus bar 42 has a plurality of barbed tabs 43 integrally formed thereon at right angles thereto; and, a stationary contact terminal 44 is secured thereon preferably by riveting. The bus bar 42 is secured to the inner surface of the upper shell 22 by insertion of the barbed tabs 43 in appropriate slots (not shown) formed in the undersurface of the shell 22 thus securing the contact 44 as a stationary switch contact.

A second contact terminal or bus bar 46 also has a plurality of right angle barbed tabs 48 provided thereon which are also inserted in suitable slots (not shown) provided in the undersurface of the upper shell 22. Terminal connector or bus bar 46 has a plurality of raised annular bosses 50 formed thereon extending downwardly therefrom and which are received through correspondingly disposed apertures 52 provided in a contact blade spring 54. Blade spring 54 is preferably formed of tempered material such as, for example, heat treated beryllium copper. The bosses 50 are then staked or riveted over the blade 54 to retain the blade 54 assembled to the strip 46.

Blade 54 has a flexible tang 58 formed therein which has a moveable electrical contact 60 attached therethrough, preferably by riveting to form a double sided contact for single pole double throw action. The end of the tang 58 is placed under compressive load by a compression spring 62 so as to provide an over-center action between the tang 58 and the remaining portion of the blade 54. It will be understood that the blade contact 60, blade 54 and terminal strip 46 comprise the common terminal of a switch.

Blade 54 has an aperture 64 formed generally centrally therein through which is received over reduced diameter pilot portion 37 of tower 36; and, the undersurface of blade 54 in the region of the rim of aperture 64 is registered against the shoulder 39 provided on tower 36.

A third terminal strip or bus bar 66 has a plurality of barbed tabs 68 formed thereon and generally at right angles thereto; and, the strip 66 has a second stationary electrical contact 70 received thereon and secured thereto preferably by riveting. The barbed tabs 68 are also received in slots (not shown) provided in the undersurface of the upper shell 22 and are so disposed so as to locate the stationary electrical contact 70 directly below the moveable contact 60. It will be understood that tabs 48 on bus bar 46 and tabs 43 on bus bar 42 are so disposed so as to locate moveable contact 60 directly below the stationary contact 44.

Aperture 64 is located on the blade spring 54 intermediate the contact 60 and the free end 56 of blade spring 54. An adjustable stop or reaction support member in the form of a screw 72 is threaded through a web 21 formed in the upper housing shell and positions the free end 56 of blade 54 to apply the desired downward force on the tower 36 to preload or bias the diaphragm 26 to provide over-center actuation of tang 58 and movement of contact 60 at a desired pressure in cavity 32.

In the presently preferred practice, the distance between the lower stationary contact 70 and the upper stationary contact 44 is determined by the amount the barbs 68 on the lower terminal strip 66 are inserted into the slots (not shown) in the underside of the upper shell 22. This latter adjustment may be made independently of the preload calibration of the blade spring 54 by adjustment screw 72.

Adjustment screw 72 may be located in any of the plurality of threaded apertures 74 formed in the web 21 to locate the end of the screw 72 to a desired distance from the point of application of the bias or preload at aperture 64. Thus, movement of the screw 72 in different locations of the aperture 74 is operative to change the spring rate of the blade spring 54 and thus the pressure response of the switching mechanism to signal pressures at the inlet port 30.

Figure 3:
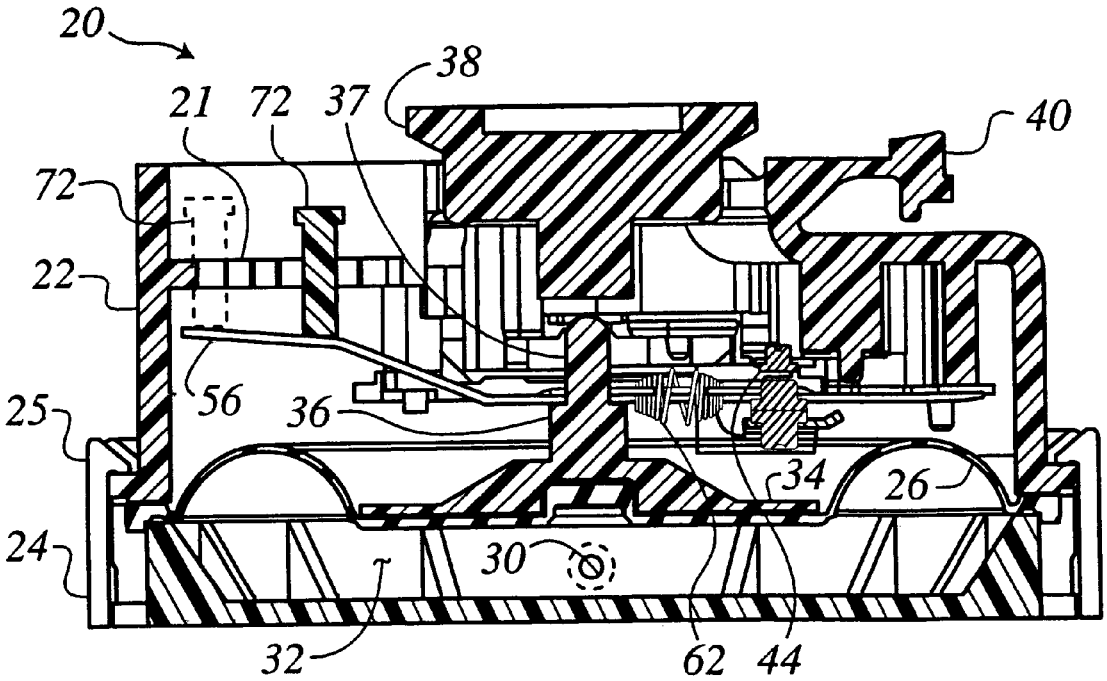
FIG. 3 is a cross-section of the assembled switch of FIG. 1.

Referring to FIG. 3, the adjustment screw 72 is shown in dashed outline as located in an alternate one of the holes 74 for providing the minimum spring rate of the blade spring 54.

Figure 4:
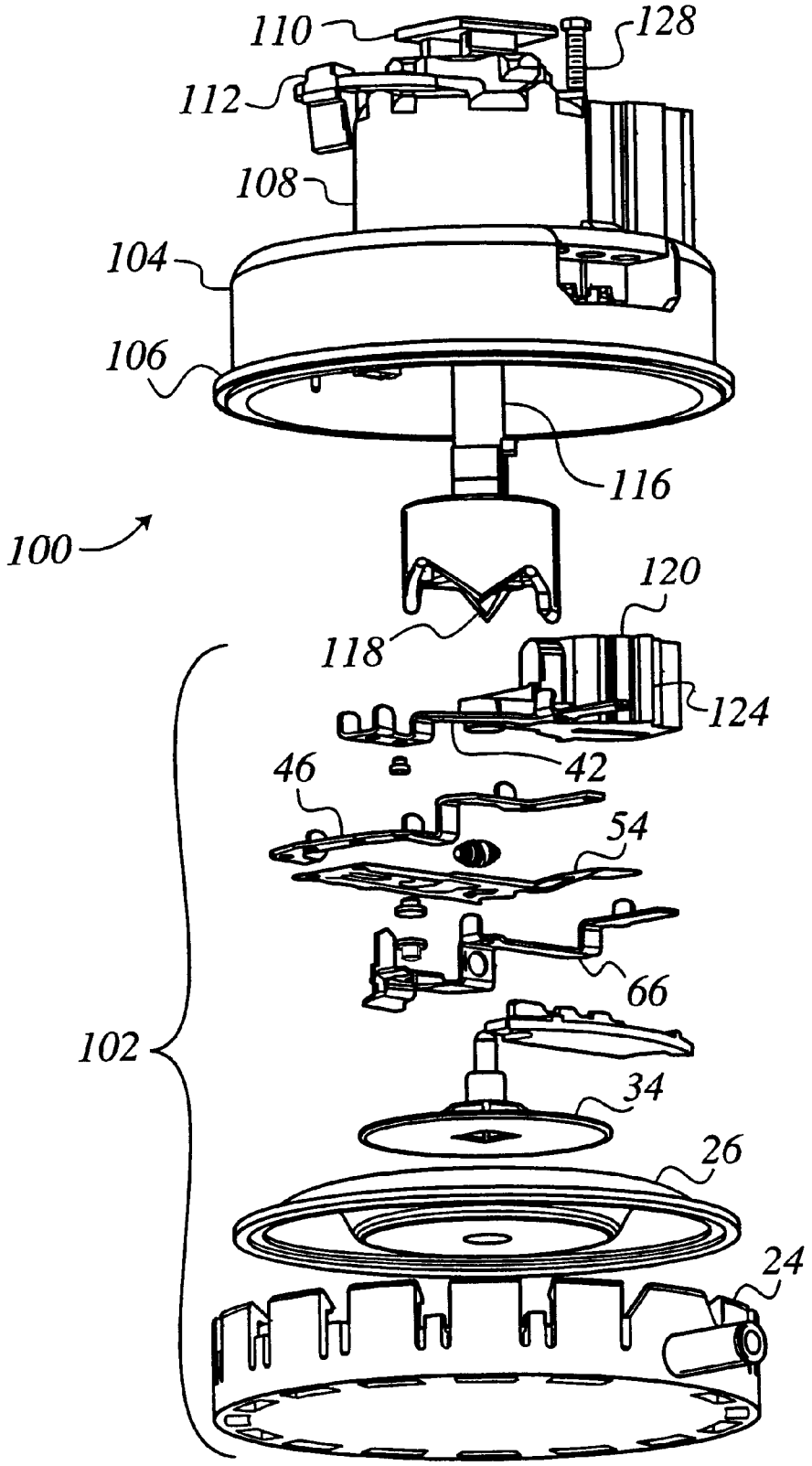
FIG. 4 is a view similar to FIG. 1 of a multilevel-setting pressure switch embodiment of present invention.
Figure 7:
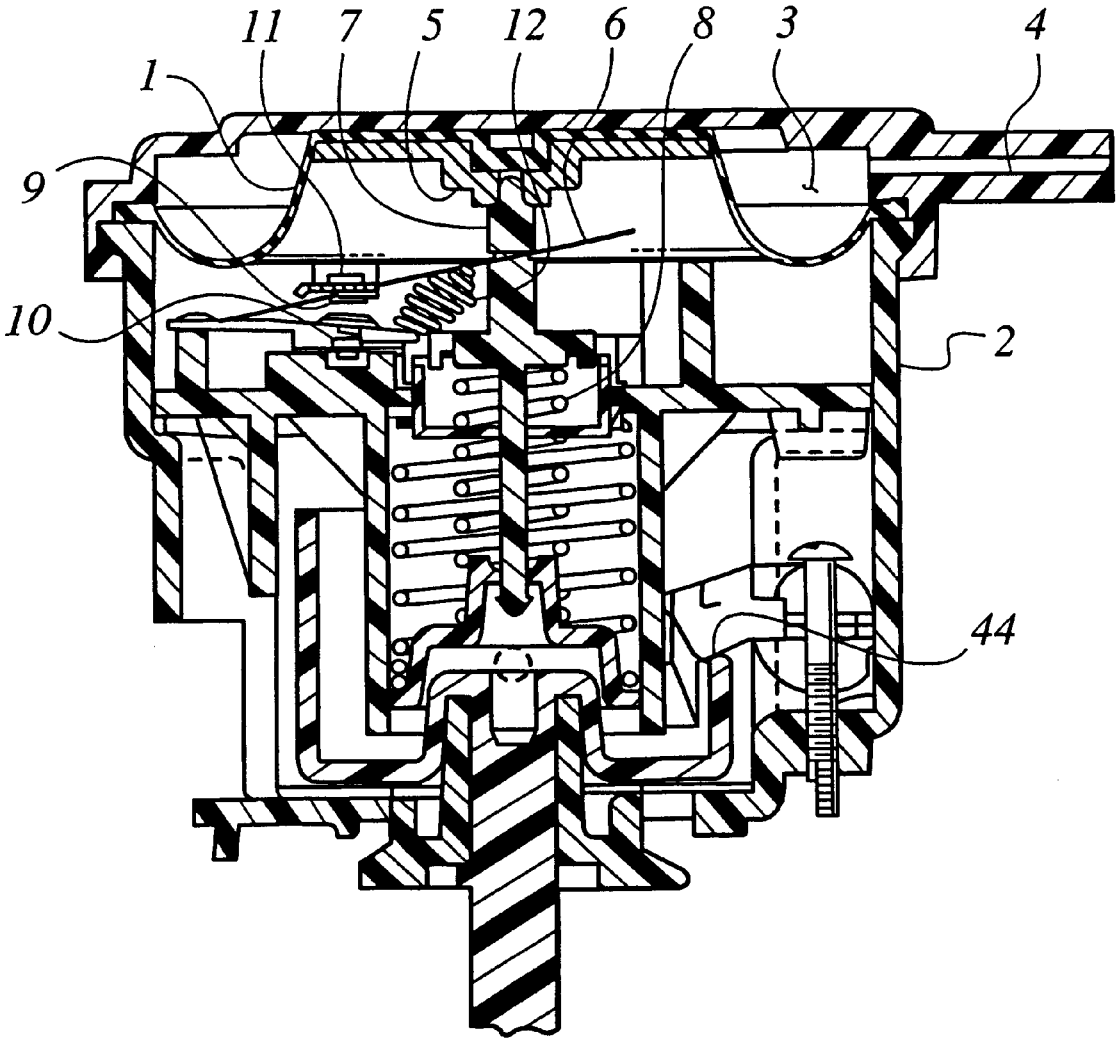
FIG. 7 is a cross-section of a prior art pressure switch.

Referring to FIG. 4, another embodiment of the invention is indicated generally at 100 in the form of a multilevel setting pressure switch which has the components indicated by reference numeral 102 common to the embodiment of FIG. 1 and FIG. 4; thus, a repeated description of these parts will be omitted for the sake of brevity.

Referring to FIGS. 4, 5 and 6, embodiment 100 has the upper shell of the housing 104 formed with the flange 106 which is similar to flange 28 of the embodiment of FIG. 1 and which is secured to the bias over the diaphragm in a manner similar to the embodiment of FIG. 1. Upper shell 104 has a tower portion 108 extending upwardly therefrom of reduced diameter from the side of the shell 104; and, tower 108 has a mounting flange 110 provided at the top thereof similar to flange 38 of the embodiment of FIG. 1. A locating tab or lug 112 is provided for orienting the pressure switch when mounted through a panel by flange 110; and, the lug 112 is similar to the lug 40 in the embodiment of FIG. 1.

The upper shell tower portion 108 has a central aperture 114 formed through the top of the tower 108 and has journalled therein an adjustment shaft 116 which has an enlarged diameter annular cam 118 formed on the lower or interior end of the shaft 116.

An adjustment block or slider 120 is slidably disposed in the shell tower 108 and guided therein by oppositely disposed guide surfaces 122, 124 for vertical movement within the upper shell. Slider 120 has a cam follower surface 126 formed thereon which is engaged by cam 118 for changing the vertical position of the slider 120. The block or slider 120 has threadedly received therein an adjustment screw 128 which extends through the slider block and has the end thereof contacting the switch blade spring in a manner similar to the screw 72 embodiment of FIG. 1. In operation, user rotation of shaft 116 causes the cam 118 to move the block 124 up or down as desired to increase or decrease the bias of the switch blade spring on the diaphragm to change the pressure setting for actuation of the switch.

Although the present invention has been described hereinabove with respect to the illustrated embodiments, it will be understood that the invention is capable of modification and variation and is limited only by the scope of the following claims.

We claim:

1. A pressure switch assembly comprising:

(a) housing means including pressure responsive means defining a pressure sensing chamber having a fluid pressure signal port, said pressure responsive means moveable in response to changes in pressure in said cavity;

(b) a blade spring anchored at one end on said housing a second end free and contacting said pressure responsive means at a point intermediate said ends and operative for biasing said pressure responsive means;

(c) adjustment means disposed for contacting said blade spring intermediate said second end and said pressure responsive member contact point; said adjustment means operative to vary said biasing on said pressure responsive member; and, (d) said blade spring including a moveable contact disposed intermediate said one end and said pressure responsive means contact point and operative to make and break with respect to a stationary contact upon a predetermined movement of said pressure responsive means.

2. The assembly defined in claim 1, wherein said switch means has a snap acting mechanism.

3. The assembly defined in claim 1 wherein said adjustment means includes a rotatable cam and a sliding cam follower.

4. The assembly defined in claim 1, wherein said pressure responsive means includes an elastomeric diaphragm and a rigid backing member therefor.

5. The assembly defined in claim 1, wherein said blade spring includes integrally formed therewith a tongue portion having one of said set of electrical contacts provided thereon.

6. The assembly defined in claim 1, wherein said switch means includes a tongue portion integrally formed on said blade spring, said tongue portion having one of said set of electrical contacts provided thereon and said switch means includes an over-center spring acting on said tongue portion.

7. The assembly defined in claim 1, wherein said adjustment means includes user rotated cam means having portions thereof extending from said housing means; and; cam follower means.

8. The assembly defined in claim 1, wherein said adjustment means includes user rotated cam means having portions thereof extending from said housing means; and cam follower means guided for sliding movement in said housing means.

9. A pressure switch assembly of the type having a housing with a pressure responsive member therein defining a pressure sensing cavity communicating with a sensing port, said assembly comprising:

(a) a rigid actuator member moveable with said pressure responsive member;

(b) an elongated contact blade means having one end anchored and a second end free and including a moveable electrical contact thereon, said blade means having portions thereof contacted at a point intermediate said one and second end directly by said actuator member for being moved thereby, said blade means operative to resiliently bias movement of said pressure responsive means, said moveable contact located intermediate said one end and said point;

(c) a stationary contact disposed on said housing for closing and opening against said moveable contact; and (d) adjustment means disposed adjacent said free end contacting said blade means and operative to adjust said blade means for biasing said pressure responsive means.

10. The assembly defined in claim 9, wherein said adjustment means includes means for selectively varying said biasing on said pressure responsive means.

11. The assembly defined in claim 9, wherein said contact blade means includes means effecting over-center snap-acting movement of said moveable contact.

* * * * *